US006105389A

United States Patent [19]

Paradowski et al.

[11] Patent Number: 6,105,389

[45] Date of Patent: Aug. 22, 2000

[54] METHOD AND DEVICE FOR LIQUEFYING A NATURAL GAS WITHOUT PHASE SEPARATION OF THE COOLANT MIXTURES

[75] Inventors: Henri Paradowski, Cergy; Alexandre Rojey, Rueil Malmaison, both of France

[73] Assignee: Institut Francais du Petrole, Rueil-Malmaison, France

[21] Appl. No.: 09/113,517

[22] Filed: Jul. 10, 1998

[30] Foreign Application Priority Data

Apr. 29, 1998 [FR] France ..... 98 05992

[51] Int. Cl.[7] ..... F25J 1/00

[52] U.S. Cl. ..... 62/613; 62/619

[58] Field of Search ..... 62/608, 612, 613, 62/619

[56] References Cited

U.S. PATENT DOCUMENTS 4,256,476 3/1981 Van Baush ..... 62/612

5,651,269 7/1997 Prevost et al. ..... 62/613

5,701,761 12/1997 Prevost et al. ..... 62/613

5,826,444 10/1998 Capron et al. ..... 62/612

*Primary Examiner*—Ronald Capossela

*Attorney, Agent, or Firm*—Antonelli, Terry, Stout & Kraus, LLP

[57] ABSTRACT

A method allowing a gaseous mixture such as a natural gas to be liquefied by using a first compressed coolant mixture $M_1$, at least partially condensed by cooling with the aid of an external coolant fluid, then subcooled, expanded, and vaporized, and a second compressed coolant mixture, cooled with the aid of an external coolant fluid, then cooled by heat exchange with the first coolant mixture $M_1$ during the first cooling stage (I), after which it is in an at least partially condensed state. The second partially condensed coolant mixture is sent without phase separation to a second cooling stage (II) where it is fully condensed, expanded, and vaporized at at least two pressure levels. The subcooled natural gas is expanded to form the LNG produced.

16 Claims, 3 Drawing Sheets

METHOD AND DEVICE FOR LIQUEFYING A NATURAL GAS WITHOUT PHASE SEPARATION OF THE COOLANT MIXTURES

FIELD OF THE INVENTION

The present invention relates to a method of and a device for liquefying a fluid or a gas mixture formed at least in part from a mixture of hydrocarbons, for example a natural gas.

BACKGROUND OF THE INVENTION

Natural gas is currently produced at sites remote from the utilization sites and is commonly liquefied so that it can be carried over long distances by tanker, or stored in a liquid form.

The methods used and disclosed in the prior art, particularly in patents U.S. Pat. No. 3,735,600 and U.S. Pat. No. 3,433,026, describe liquefaction methods principally comprising a first stage in which the natural gas is precooled by vaporizing a coolant mixture, and a second stage that enables the final natural gas liquefaction operation to be conducted and the liquefied gas to be obtained in a form in which it can be transported or stored, cooling during this second stage also being provided by vaporization of a coolant mixture.

In such methods, the fluid mixture used as the coolant fluid in the external cooling cycle is vaporized, compressed, cooled by exchanging heat with an ambient medium such as water or condensed air, expanded, and recycled.

The coolant mixture used in the second stage in which the second cooling step is performed, is cooled by heat exchange with the ambient coolant medium, water or air, then the first stage in which the first cooling step is performed.

After the first stage, the coolant mixture is in the form of a two-phase fluid having a vapor phase and a liquid phase. Said phases are separated, in a separating vessel for example, and sent to a spiral tube heat exchanger for example in which the vapor fraction is condensed while the natural gas is liquefied under pressure, cooling being provided by vaporization of the liquid fraction of the coolant mixture. The liquid fraction obtained by condensation of the vapor fraction is subcooled, expanded, and vaporized for final liquefaction of the natural gas, which is subcooled before being expanded by a valve or turbine to produced the desired liquefied natural gas (LNG).

The presence of a vapor phase requires a condensation operation for the coolant mixture in the second stage, which requires a relatively complex and expensive device.

The proposal has also been made in Patent FR-2,734,140 by the applicant of operating under selected pressure and temperature conditions to obtain, at the output of the first coolant stage, a fully condensed single-phase coolant mixture.

This brings about constraints which can be burdensome for process economics, particularly because the pressure at which the coolant mixture used in the second stage is compressed can be relatively high.

SUMMARY OF THE INVENTION

The present invention relates to a method and its implementing device that overcomes the aforesaid drawbacks of the prior art.

The present invention relates to a method for liquefying a natural gas.

It is characterized by comprising, in combination, at least the following steps.

a) the natural gas is cooled in a first coolant step (I) to a temperature less than −30° C. with the aid of a first cooling cycle operating with a first coolant mixture $M_1$, said first coolant mixture being compressed, at least partially condensed by cooling with an external coolant fluid, precooled, then subcooled, expanded, and vaporized, b) the natural gas from step a) is condensed and subcooled during a second cooling step (II) with the aid of a second cooling cycle operating with a second coolant mixture $M_2$, said second coolant mixture being compressed, cooled with an external coolant fluid, then cooled by heat exchange with the first coolant mixture $M_1$ during the first cooling step (I), after which it is in an at least partially condensed state, said second partially condensed mixture is sent without phase separation to the second cooling step where it is totally condensed, expanded, and evaporated at at least two pressure levels, and c) said subcooled natural gas from step b) is expanded to form the LNG produced.

The first coolant mixture is, for example, expanded at at least two pressure levels.

The first mixture $M_1$ can include at least ethane, propane, and butane.

The second mixture $M_2$ includes, for example, at least methane, ethane, and nitrogen, and its molecular weight can be between 22 and 27.

Any available ambient fluid, such as air, fresh water, or seawater, can be used as the external cooling fluid.

The first cooling step and the second cooling step, for example, are implemented in the same exchange line comprising one or more plate exchangers mounted in parallel.

The temperature Tc is chosen, for example, in such a way as to balance the compression powers of the two cooling cycles providing cooling steps (I) and (II), each of said cycles having a compression system driven by an identical gas turbine.

The second mixture $M_2$ is compressed at a pressure of, for example, between 3 and 7 MPa.

The second mixture $M_2$ is vaporized at a first pressure level, for example, between 0.1 and 0.3 MPa and at a second pressure level of, for example, between 0.3 and 1 MPa.

During the second cooling step (II), the second coolant mixture $M_2$ can be separated into at least two fractions, said fractions can be expanded at different pressure levels, and simultaneous heat exchange can be produced between at least the stream of natural gas, whereby the second mixture $M_2$ under pressure circulates in the same direction, and said expanded mixture fractions at different pressure levels circulates in the opposite direction.

The second cooling step is effected, for example, in at least a first section ($E_{41}$) and a second section ($E_{42}$), said sections being successive, where a first fraction $F_1$ of the coolant mixture $M_2$ is separated, and said first fraction $F_1$ is subcooled to a temperature close to its bubble point at a first expansion pressure level, expanding said first fraction at an expansion pressure level $P_1$, and said first subexpanded expansion fraction is vaporized to ensure cooling of said first section, at least in part, and subcooling of the remaining second fraction $F_2$ of mixture $M_2$ is continued up to a temperature close to its bubble point at a second expansion pressure level $P_2$ and said second fraction is vaporized to ensure cooling of the second section, at least in part.

The condensed mole fraction of second mixture $M_2$ when it leaves the first cooling step is, for example, equal to at least 90%.

The molar ratio between the total flow of the coolant mixture $M_2$ and the flow of the natural gas is, for example, less than 1.

The temperature Tc is chosen, for example, to be in the interval [−40 to −70° C.].

The invention also relates to a device for liquefying a natural gas. It is characterized by comprising:

a first cooling zone (I) designed to operate under temperature conditions down to at least −30° C. and to obtain at the output an at least partially condensed coolant mixture $M_2$ used in a second cooling zone (II), and said natural gas subcooled down to at least −30° C., said first zone comprising a first precooling circuit with the aid of a first coolant mixture $M_1$, a second cooling zone (II) designed to operate at a temperature T at least less than −140° C., after which said natural gas coming from the first cooling zone (I) is cooled to a temperature of less than −140° C. by vaporization of said coolant mixture $M_2$ coming from said first zone and sent without phase separation to the second cooling zone (II), means for expanding said natural gas coming from the second cooling zone, means for expanding and means for compressing said first and second coolant mixture.

The second cooling zone is comprised for example of a single exchange line comprising four independent passes ($L_1$, $L_2$, $L_3$, and $L_4$) allowing passage of subcooled natural gas and of the coolant mixture $M_2$, and the fractions of said coolant mixture $M_2$ after expansion.

According to another embodiment, the second cooling zone can comprise an exchange section ($E_4$) including at least two successive sections ($E_{41}$, $E_{42}$) and four exchange lines ($L_1$, $L_2$, $L_3$, and $L_4$).

The first and second cooling zones are, for example, integrated into a single exchange line.

BRIEF DESCRIPTION OF THE DRAWINGS

The first and second cooling zones have, for example, coolant systems each driven by a gas turbine.

Other advantages and characteristics of the invention will emerge from reading the description provided hereinbelow as examples in the framework of nonlimiting applications to liquefaction of natural gas, with reference to a attached drawings wherein.

DETAILED DESCRIPTION

Figure 1:
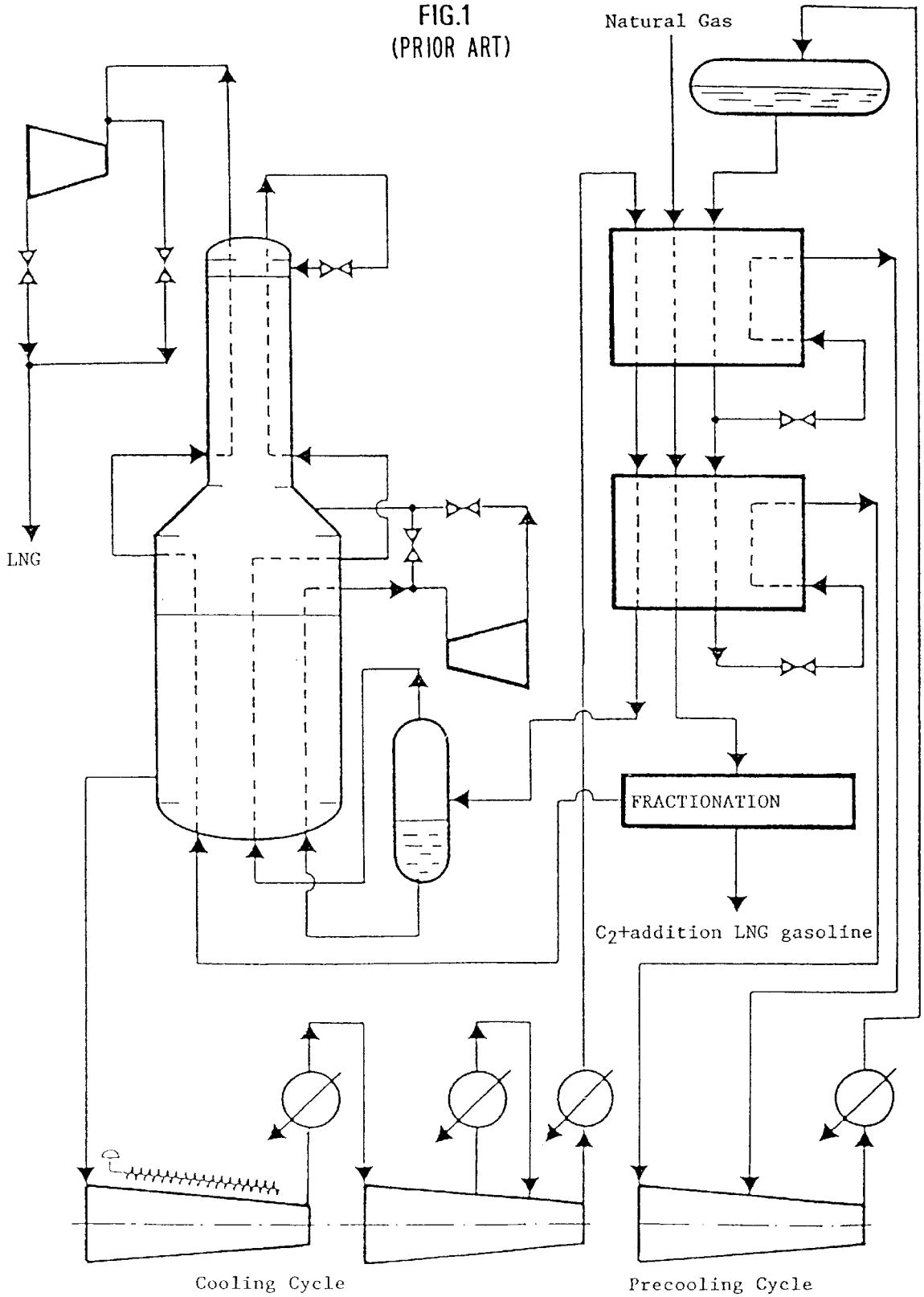
FIG.1 (PRIOR ART)
FIG. 1 shows schematically an example of the liquefaction cycle as described and used in the prior art.

FIG. 1 represents a flowchart of a natural gas cooling method used in the prior art.

The method comprises a first natural gas cooling stage at the output of which the temperature of the natural gas and that of the coolant mixture used are approximately −30° C.

At the output from the first stage, the coolant mixture used in the second cooling stage is in the form of a two-phase fluid having a vapor phase and a liquid phase, said phases being separated with the device represented in the figure by a separating vessel. These two phases are sent to a spiral tube heat exchanger for final cooling of the natural gas precooled in the first stage. For this purpose, the vapor phase coming from the separator vessel is condensed, using the liquid fraction as a cooling fluid, then subcooled and vaporized to cool and liquefy the natural gas.

Principle of Method According to the Invention

It has been discovered that it is possible to liquefy a natural gas in two cooling steps (I) and (II), each of the steps operating with a cooling cycle using, respectively, a first coolant mixture $M_1$ and a second coolant mixture $M_2$, each of these coolant mixtures being vaporized at at least two pressure levels to provide each of the cooling steps, compressed, condensed, then expanded, without involving phase separation of one of the coolant mixtures, and completing condensation of coolant mixture $M_2$ during the second cooling stage.

It has also been discovered that the two cooling steps (I) and (II) can be accomplished by a single exchange line having one or more plate exchangers mounted in parallel.

By comparison with the prior art, the second coolant mixture $M_2$ is partially condensed when it leaves the first cooling stage, transmitted without phase separation to the second cooling stage, then totally condensed during the second stage.

Figure 2:
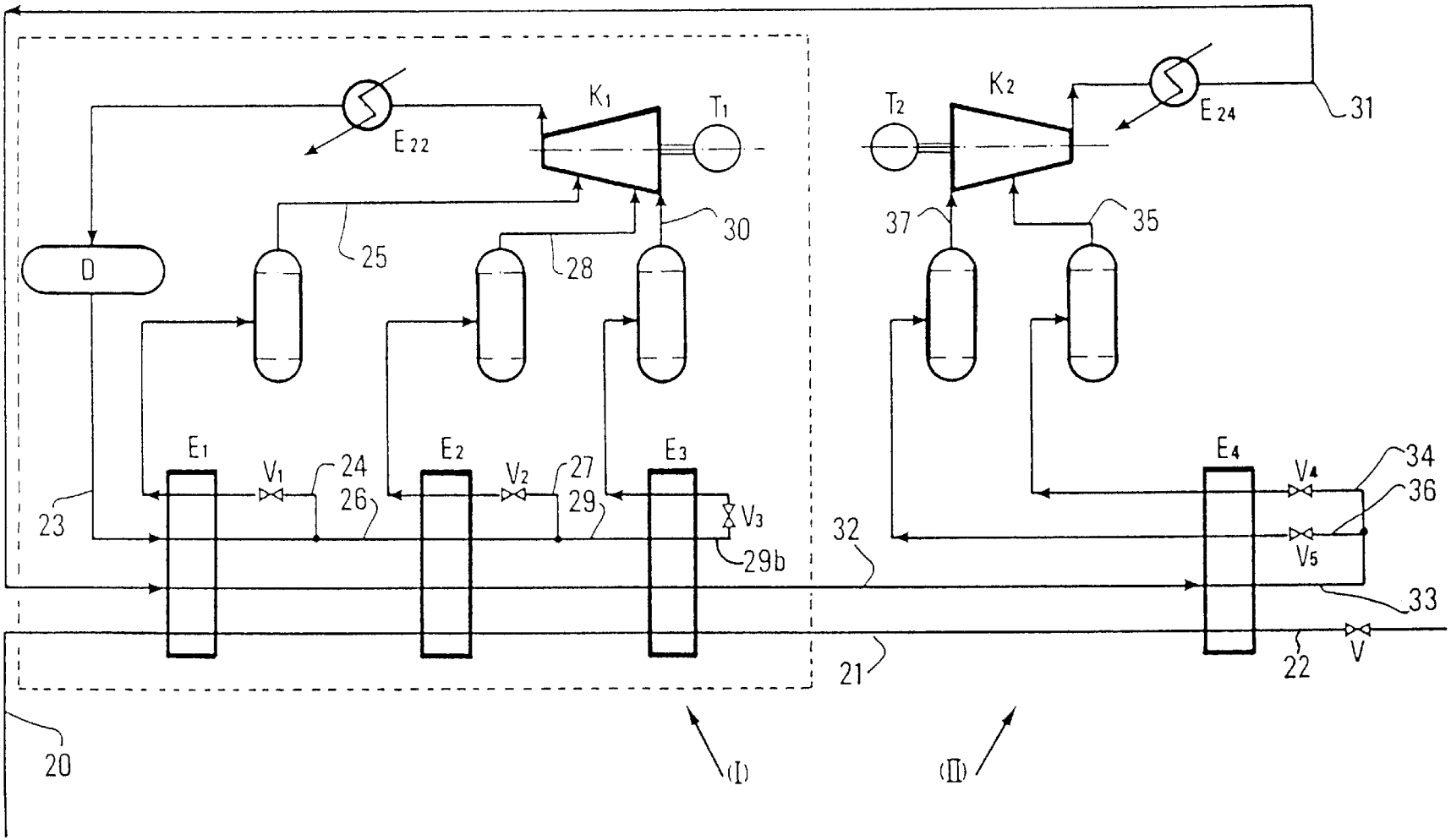
FIG. 2 shows an alternative embodiment of the method according to the invention.

The operating principle of the method according to the invention is illustrated by the diagram in FIG. 2 which shows one embodiment.

The natural gas enters first cooling stage (I) through a pipe 20 and leaves it through a pipe 21 and is then sent to second cooling stage (II) which it leaves through a pipe 22 before being expanded by a valve V or a turbine for producing the LNG.

The first cooling stage (I) operates with the aid of a first coolant mixture $M_1$ which is compressed in compressor $K_1$, which might be powered by a turbine $T_1$, then condensed in exchanger $E_{22}$ with the aid of an available external cooling fluid. The mixture thus condensed is collected in a vessel D, then sent through a pipe 23 to the first cooling stage. It is then subcooled in a first section $E_1$ of the first cooling stage. When it leaves this first section $E_1$ in pipe 26, a first fraction $F_1$ of mixture $M_1$ is expanded by an expansion valve $V_1$ located on a pipe 24, at a first pressure level then vaporized in said first section $E_1$ to cool the natural gas in pipe 20 and the condensed coolant mixture. The vapor phase thus obtained is recycled by a pipe 25 to an intermediate stage of compressor $K_1$ corresponding to the pressure level of the vapor mixture thus obtained. The remainder of mixture $M_1$ is subcooled in a second section $E_2$ of the first cooling stage. When it leaves this second section $E_2$ in pipe 29, a second fraction $F_2$ of mixture $M_1$ is expanded at a second pressure level by an expansion valve $V_2$ located on a pipe 27, then vaporized in said second section $E_2$ to ensure cooling of the natural gas in pipe 20 and the coolant mixture. The vapor phase thus obtained is recycled by a pipe 28 to a second intermediate stage of compressor $K_1$ corresponding to the pressure level of the vapor mixture thus obtained. The last fraction $F_3$ of mixture $M_3$ is subcooled in a third section $E_3$ of the first cooling stage. When it leaves this section $E_3$, this remaining fraction of mixture $M_1$ is expanded by an expansion valve $V_3$ in pipe **29*b* to a third pressure level, then vaporized in said third section $E_3$ to cool the natural gas in pipe 20 and the coolant mixture. The vapor phase thus obtained is recycled to the input of compressor $K_1$ through a pipe 30**.

The number of sections in the first cooling stage can vary for example between 1 and 4 and can result from economic optimization.

In certain cases it is also possible to condense mixture $M_1$ only partially in exchanger $E_{22}$, then complete its condensation during the first cooling step. In the principle of the method according to the invention, however, mixture $M_1$ preferably circulates with a substantially constant composition without phase separation between the liquid and vapor phases, which would lead to each of these phases going through a different circuit.

The external cooling fluid in exchanger $E_{22}$ can be an available ambient fluid such as for example air, fresh water, or seawater.

The coolant mixture $M_1$ is thus preferably fully condensed by cooling with the aid of the available ambient cooling fluid then subcooled, expanded, and vaporized at at least two pressure levels.

Mixture $M_1$ includes for example ethane, propane, and butane. It can also include other components such as, for example, methane and pentane without departing from the framework of the method according to the invention.

The proportions, expressed in mole fractions, of ethane ($C_2$), propane ($C_3$), and butane ($C_4$) in coolant mixture $M_1$ are preferably in the following ranges:

C2=[30, 70%]7

C3=[30, 70%]

C4=[0, 20%]

The second cooling stage (II) operates with a second coolant mixture $M_2$ which is compressed in compressor $K_2$, which might be powered by a turbine $T_2$, then cooled in exchanger $E_{24}$ with the aid of the external available cooling fluid. Mixture $M_2$ is sent through a pipe 31 to the cooling sections of the first stage, $E_1$, $E_2$, and $E_3$, in which it is cooled and at least partially condensed. It is then sent to second cooling stage (II) through a pipe 32. It is then completely condensed and subcooled in cooling section $E_4$ of the second stage. Coolant mixture $M_2$ passes from first stage (I) to second stage (II) without phase separation.

This method enables in particular the two cooling stages (I) and (II) to be accomplished in the same exchange line.

At the output of cooling section $E_4$, mixture $M_2$ is extracted by a pipe 33 and separated into two fractions $F'_1$ and $F'_2$ for example.

The first fraction $F'_1$ of mixture $M_2$ is expanded in an expansion valve $V_4$ fitted to a pipe 34 to a first pressure level. It then partially cools the natural gas and coolant mixture $M_2$ in section $E_4$. The vapor phase thus obtained is recycled through a pipe 35 to an intermediate stage of compressor $K_2$ corresponding to the pressure level of the vapor mixture thus obtained.

Second fraction $F'_2$ of remaining mixture $M_2$ is expanded at a second pressure level, less than the first pressure level, by an expansion valve $V_5$ disposed on a pipe 36 then vaporized to cool the natural gas and the coolant mixture in section $E_4$. The vapor phase thus obtained is recycled to the input of compressor $K_2$ through a pipe 37.

Figure 2A:
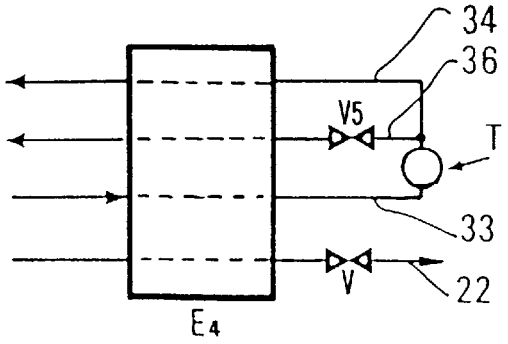
FIG. 2A shows another embodiment of the second cooling stage.

FIG. 2A shows schematically another variant for expanding mixture $M_2$ at the second cooling stage, in which the entire condensed subcooled mixture $M_2$ obtained at the output of $E_4$ is expanded by a liquid expansion turbine T to the aforesaid pressure level and then separated into two fractions $F'_1$ and $F'_2$. Fraction $F'_1$ is then sent directly to exchange section $E_4$ without it being necessary to install valve $V_4$ (FIG. 2). Fraction $F'_2$ is expanded once again to the aforesaid pressure level through expansion valve $V_5$ then sent to exchange section $E_4$.

Coolant mixture $M_2$ includes for example methane and ethane. It can also include other components such as, for example, nitrogen and propane without departing from the framework of the method according to the invention.

Its molecular weight is preferably between 22 and 27.

The proportions expressed in mole fractions of nitrogen ($N_2$), methane ($C_1$), ethane ($C_2$) and propane ($C_3$) in coolant mixture $M_2$ are preferably in the following ranges:

N2=[0, 10%]

C1=[30, 50%]

C2=[30, 50%]

C3=[10, 10%]

The output temperature Tc of the first cooling stage (of the natural gas) can be chosen so as to optimally distribute the compression powers in the two cooling cycles providing cooling stages (I) and (II). In a preferred version of the method according to the invention, each of said cycles has a compression system driven by an identical gas turbine.

Precooling temperature Tc at the output of the first cooling stages is thus preferably between −40 and −70° C.

In a preferred version of the method, the compression powers involved in the two cooling cycles are similar, the compression power involved in cooling stage (II) being preferably between 45 and 55% of the compression power involved in cooling stage (I).

In a preferred version of the method, the condensed mole fraction of the coolant mixture $M_2$ leaving the first stage is at least equal to 90%.

In a preferred version, the molar ratio of the flow of coolant mixture $M_2$ to the flow of natural gas is less than 1.

The number of expansion pressure levels in second cooling stage (II) can vary for example between 2 and 4 and results from a choice leading to economic optimization.

The coolant mixture $M_2$ is compressed to a pressure of between 3 and 7 MPa, for example.

It is vaporized at at least two pressure levels. In this case, the first pressure level is between 0.1 and 0.3 MPa, for example, and the second pressure level is between 0.3 and 1 MPa, for example.

The number of heat exchange sections can vary. Thus, in the embodiment shown in FIG. 2, one operates with two expansion pressure levels and one exchange section $E_4$, operating throughout this exchange section, a simultaneous heat exchange between at least four flows circulating in parallel in at least four different passes. These four flows can be the subcooled natural gas coming from the first cooling stage, the partially condensed mixture $M_2$ under pressure, these two flows circulating in the same direction, and the two fractions of mixture $M_2$ expanded to different pressure levels circulating in the opposite direction.

Figure 3:
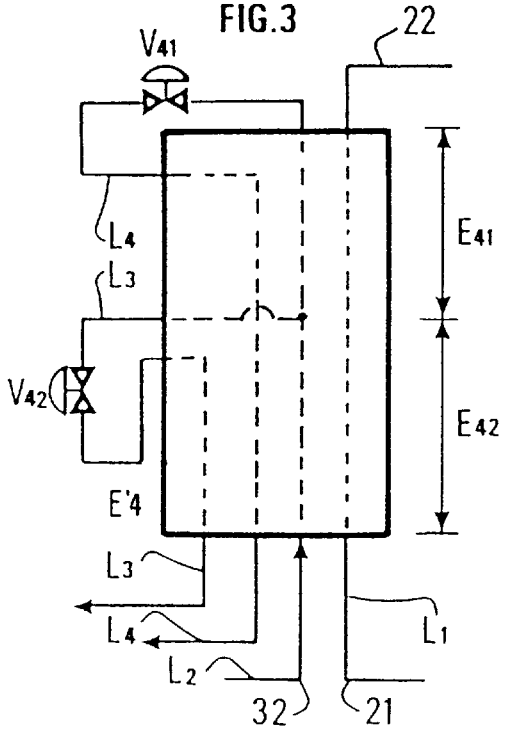
FIG. 3 shows schematically a possible heat exchanger for the second cooling step.

It is also possible to operate according to the embodiment illustrated in FIG. 3.

In this example, the exchange section of the second cooling stage (II) has two successive sections $E_{41}$ and $E_{42}$.

The natural gas flow introduced through pipe 21 circulates in line $L_1$ through exchange section $E'_4$.

The second coolant mixture $M_2$ introduced through pipe 32 circulates in a line $L_2$.

A first fraction $F''_1$ of this mixture $M_2$, subcooled to a temperature close to its bubble point after expansion, is taken and sent by a line $L_3$ to an expansion valve $V_{42}$ where it is expanded to a first pressure level $P_1$. This first fraction $F''_1$ is vaporized at pressure $P_1$ in exchange section $E_{42}$ to provide at least part of the cooling of this section.

The remaining or second fraction $F''_2$ continues to circulate in line $L_2$ where it continues to be subcooled to a temperature close to its bubble point at second expansion pressure level $P_2$. It is then expanded at pressure $P_2$ through an expansion valve $V_{41}$ and then vaporized in section $E_{41}$ to cool it. When it leaves this section $E_{41}$, this fraction is at least partially vaporized, and vaporization is completed in section $E_{42}$. Second fraction $F''_2$ circulates in line $L_4$.

This produces simultaneous exchange between the natural gas and mixture $M_2$ circulating under pressure in one direction and the fractions of mixture $M_2$ expanded at different pressure levels circulating in the opposite direction.

According to another embodiment, not shown, the fully condensed,. subcooled natural gas can be expanded by an expansion valve Vi to a pressure Pi at an intermediate level of exchange section $E_4$ (for example between subsections $E_{41}$ and $E_{42}$). The pressure Pi is chosen so that, after expansion to this pressure, the natural gas remains fully condensed.

The various expansion valves of coolant mixtures ($V_1$, $V_2$, $V_{43}$, $V_4$, $V_5$, $V_{41}$, $V_{42}$, Vi) can be partly or totally replaced by liquid expansion turbines, which does not alter the main characteristics of the method according to the invention.

In sum, the process is characterized in particular in that:

(1) the natural gas under pressure is cooled and possibly partially condensed during a first cooling stage (I) to a temperature Tc at least less than −30° C., with the aid of a first cooling cycle operating with the aid of a coolant mixture $M_1$ which is compressed, at least partially condensed by cooling with the aid of the available ambient cooling fluid, then subcooled, expanded, and vaporized at at least two pressure levels.

(2) The natural gas under pressure is then totally condensed then subcooled during a second cooling stage (II) with the aid of a second cooling cycle operating with the aid of a second coolant mixture $M_2$ which is compressed, cooled, and at least partially condensed during the first cooling stage by heat exchange with first coolant mixture $M_1$, totally condensed, then subcooled during the second cooling stage, then expanded and vaporized at at least two pressure levels, mixture $M_2$ being totally condensed then subcooled during two successive cooling stages (I) and (() without separation between the liquid and vapor phases.

(3) The subcooled natural gas is expanded to form the LNG produced.

Advantages

One of the advantages offered by the method according to the invention is being able to accomplish all the cooling in stages (I) and (II) in a single exchange line, comprising one or more plate exchangers mounted in parallel.

Figure 4:
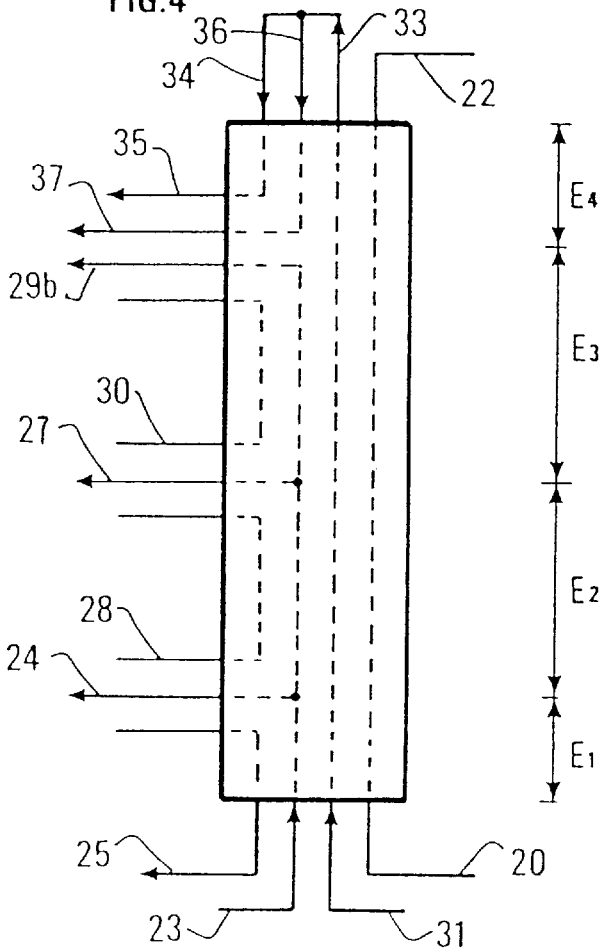
FIG. 4 illustrates a variant in which the two cooling steps are carried out in a single exchange line.

Thus for example all the exchanges effected in sections $E_1$, $E_2$, $E_3$, and $E_4$ of the embodiment illustrated in FIG. 2 can be operated with a single plate exchanger or two plate exchangers butt-welded in series, for example exchangers of the plate and fin tube type made of brazed aluminum. This exchanger is designed for intermediate offtakes and injections of coolant mixture, but since no intermediate phase separation is carried out, the exchanges as a whole can be effected in a single piece of compact equipment as shown schematically in FIG. 4 where the numbers for the pipes introducing and removing the various coolant mixture flows correspond to those in FIG. 2.

Since the unit surface area of an assembly of brazed plates is limited, several exchangers of this type can be installed in parallel, making possible a modular design of the liquefaction facility. This modular design is another advantage of the method according to the invention, as it becomes possible to shut off one of the modules of the exchange line (for example for maintenance, inspection, or repair operations) without shutting down the entire line and thus without having to shut down LNG production, which is thus only slightly reduced.

Each of the two cooling cycles providing cooling stages (I) and (II) has a compression system preferably driven by an independent gas turbine $T_1$ and $T_2$.

The method according to the invention also allows the mechanical powers to be balanced between the two cooling stages and hence allows operation using two identical drive gas turbines, which is a cost advantage (outlay and maintenance).

The method according to the invention does not require phase separation of the coolant mixtures, so that coolant mixtures of constant composition can be used at any point in the process, facilitating operation of the process in terms of control and regulation.

The method according to the invention requires only limited flows of coolant mixtures, particularly of the cryogenic coolant mixture $M_2$ whose molar flow is always less than that of the natural gas to be liquefied. This is also an advantage since, by comparison to known liquefaction processes, one can reduce the size of the equipment necessary for implementing this cryogenic coolant mixture (compressors, lines, and intake tanks of the compressors, in particular).

The method according to the invention is particularly energy-saving, since it liquefies the natural gas using mechanical power generally less than 800 kJ/kg LNG, which is also more than 10% lower than that encountered with the best competitive processes. This low energy consumption allows significantly more LNG to be produced than the processes known to date, with the same drive gas turbines.

EXAMPLE

The method according to the invention is illustrated by the following numerical example, described in relation to FIGS. 2 and 2A.

A natural gas is introduced through line 20 to exchanger $E_1$ at a pressure of 6 MPa and a temperature of 30° C. The composition of this gas is the following, in mole fractions (%):

methane: 87.24
ethane: 6.40
propane 2.26
isobutane: 0.48
n-butane: 0.46
pentanes: 0.09
nitrogen 3.07

This natural gas is cooled to a temperature of −60° C. and partially condensed, in exchange sections $E_1$, $E_2$, and $E_3$ which constitute cooling stage (I). This cooling stage (I) employs a coolant mixture $M_1$ whose composition is the following in mole fractions (%):

ethane: 50.00 propane: 50.00

The mixture $M_1$ is compressed in the gas phase in multistage compressor $K_1$ to a pressure of 2.4 MPa. It is cooled and condensed to a temperature of 30° C. in exchanger $E_{22}$ which it leaves fully condensed and is then admitted to exchange section $E_1$ through line 23. This condensed mixture is then subcooled in exchange section $E_1$ to a temperature of 0° C. When it leaves this first exchange section, a first fraction $F_1$ of mixture $M_1$ is removed through line 24 and expanded by expansion valve $V_1$ to a pressure of 1.27 MPa. This fraction $F_1$ is next vaporized in section $E_1$ and then sent through line 25 to the intake of the last stage of compressor $K_1$. The molar flow of fraction $F_1$ represents 36.4% of the total molar flow of mixture $M_1$ leaving compressor $K_1$.

The remainder of mixture $M_1$ is sent through line 26 to exchange section $E_2$ where it is cooled to a temperature of −30° C. When it leaves this second exchange section, a second fraction $F_2$ of mixture $M_1$ is removed through line 27 and expanded by expansion valve $V_2$ to a pressure of 0.55 MPa. This fraction $F_2$ is and vaporized in section $E_2$ then sent through line 28 to the intake of the intermediate stage of compressor $K_1$. The molar flow of fraction $F_2$ represents 36.1% of the total molar flow of mixture $M_1$ leaving compressor $K_1$.

The remainder of mixture $M_1$, representing a fraction $F_3$, is sent through line 29 to exchange section $E_3$ where it is cooled to a temperature of −60° C. When it leaves this third exchange section, this fraction $F_3$ is expanded by expansion valve $V_3$ to a pressure of 0.19 MPa. This fraction $F_3$ is then vaporized in section $E_3$ and sent through line 30 to the intake of the first stage of compressor $K_1$.

The cooled, particularly condensed natural gas leaving $E_3$ at −60° C. is then sent along line 21 to exchange section $E_4$ which constitutes cooling stage (II). This cooling stage (II) employs a coolant mixture $M_2$ whose composition is the following in mole fractions (%):

methane: 47.40 ethane: 45.00 propane: 2.00 nitrogen: 5.60

Mixture $M_2$ is compressed in the gas phase in multistage compressor $K_2$ to a pressure of 5.55 MPa. It is cooled to a temperature of 30° C. in exchanger $E_{24}$ and is sufficiently gaseous when it leaves it to be admitted to exchange section $E_1$ through line 31. It is then cooled and fully condensed in exchange sections $E_1$, $E_2$, and $E_3$ to a temperature of −60° C. It is then admitted through line 32 into exchange section $E_4$ where it is subcooled to a temperature of −150° C. This subcooled mixture $M_2$ is then sent through line 33 to a liquid expansion turbine T where it is expanded to a pressure of 0.58 MPa.

After this first expansion, a fraction $F'_1$ of the mixture is removed and sent through line 34 to exchange section $E_4$ where this fraction $F'_1$ is vaporized. Fraction $F'_1$ thus vaporized is then sent through line 35 to the intake of the second stage of compressor $K_2$. The molar flow of this fraction $F'_1$ represents 50% of the total molar flow of mixture $M_2$ leaving compressor $K_2$.

The other fraction $F'_2$ of mixture $M_2$ obtained after expansion in turbine T is sent through line 36 to expansion valve $V_5$ where it is expanded to a pressure of 0.27 MPa. This fraction $F'_2$ is then sent after expansion to exchange section $E_4$ where it is vaporized and sent through line 37 to the intake of the first stage of compressor $K_2$.

The natural gas thus liquefied and subcooled is then obtained at the output of exchange section $E_4$ through line 22 at a pressure of 5.92 MPa and a temperature of −150° C. It can then be expanded by an expansion valve or turbine to produce the LNG.

In the example thus provided, the molar ratio of the flow of coolant mixture $M_2$ to the flow of natural gas treated is equal to 0.883.

For production of LNG of 450516 kg/h, the mechanical powers of compressors $K_1$ and $K_2$ are 46474 kW and 45371 kW respectively, namely a total mechanical power d representing 734 kJ per kg of LNG produced at −150° C.

We claim:

1. A method of liquefying a natural gas, comprising the steps of:

(a) subjecting the natural gas to a first cooling cycle in which the natural gas is cooled to a temperature at least as low as −30° C. by a first coolant mixture that has been compressed, at least partially condensed by cooling with a first external coolant fluid, subcooled, expanded, and vaporized;

(b) after step (a), subjecting the natural gas to a second cooling cycle in which the natural gas is condensed and subcooled by a second coolant mixture that has been compressed, cooled with a second external coolant fluid, cooled by heat exchange with the first coolant mixture during the first cooling cycle, to bring the second coolant mixture to an at least partially condensed state, and subjected without phase separation to the second cooling step, to cause the second coolant mixture to be totally condensed, expanded, and evaporated at at least two pressure levels; and (c) after step (b), expanding the natural gas to form liquefied natural gas.

2. A method according to claim 1, wherein the first coolant mixture includes at least ethane, propane, and butane.

3. A method according to claim 1, wherein the second coolant mixture includes at least methane, ethane, propane, and nitrogen and has a molecular weight between 22 and 27.

4. A method according to claim 1, wherein at least one of the external collant fluids is an available ambient fluid.

5. A method according to claim 1, wherein the first cooling cycle and the second cooling cycle are performed in a single exchange line having plate exchangers mounted in parallel.

6. A method according to claim 1, wherein in the first cooling cycle the natural gas is cooled to a temperature such as to balance the compression powers in the first and second cooling cycles and each of the first and second cooling cycles includes a compression step performed by identical gas turbines.

7. A according to claim 1, wherein the second coolant mixture is compressed at a pressure of between 3 and 7 MPa.

8. A method according to claim 1, wherein the second coolant mixture is evaporated at a first pressure level of between 0.1 and 0.3 MPa and at a second pressure level of between 0.3 and 1 MPa.

9. A method according to claim 1, wherein the second coolant mixture upon leaving the first cooling cycle has a condensed mole fraction of at least 90%.

10. A method according to claim 1, wherein the molar ratio between the second coolant mixture flow and the natural gas flow is less than 1.

11. A method according to claim 1, wherein in the first cooling cycle the natural gas is cooled to a temperature in the range of −40° to −70° C.

12. Apparatus for liquefying a natural gas, comprising:

means defining a first cooling zone, including a first precooling circuit having a first coolant mixture therein, to cool the natural gas down to a temperature at least as low as −30° C. and to at least partially condense a second coolant mixture;

means defining a second cooling zone, to cool the natural gas from said first cooling zone to a temperature at least as low as −140° C. by vaporization of the at least partially condensed second coolant mixture from said first cooling zone without phase separation;

means for expanding the natural gas cooled in said second cooling zone;

means for expanding the first and second coolant mixtures;

means for compressing the first and second coolant mixtures.

13. An apparatus according to claim 12, wherein said second cooling zone comprises a single exchange line having four independent passes, allowing passage of natural gas from said first cooling zone, the second coolant mixture, and fractions of said coolant mixture after expansion.

14. An apparatus according to claim 12, wherein said second cooling zone includes a heat exchange section including at least two successive sections and four exchange lines.

15. An apparatus according to claim 12, wherein said first and second cooling zones are built into a single exchange line.

16. Apparatus according to claim 12, wherein said first and said second cooling zones further include compression systems, and gas turbines for driving said compression systems.

* * * * *